US007892061B2

(12) United States Patent
Bewlay et al.

(10) Patent No.: US 7,892,061 B2
(45) Date of Patent: Feb. 22, 2011

(54) HERMETICAL LAMP SEALING TECHNIQUES AND LAMP HAVING UNIQUELY SEALED COMPONENTS

(75) Inventors: Bernard P. Bewlay, Schenectady, NY (US); James A. Brewer, Scotia, NY (US); Sylvain S. Coulombe, N—D Ile-Perrot PQ (CA); Sylvia M. DeCarr, Schenectady, NY (US); Luana E. Iorio, Clifton Park, NY (US); Anteneh Kebbede, Albany, NY (US); Timothy J. Sommerer, Ballston Spa, NY (US); James S. Vartuli, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 533 days.

(21) Appl. No.: 11/711,597

(22) Filed: Feb. 27, 2007

(65) Prior Publication Data

US 2007/0161319 A1 Jul. 12, 2007

Related U.S. Application Data

(62) Division of application No. 10/323,252, filed on Dec. 18, 2002, now Pat. No. 7,215,081.

(51) Int. Cl.
*H01J 9/00* (2006.01)

(52) U.S. Cl. ..... 445/43; 313/623

(58) Field of Classification Search ..... 313/623, 313/624, 625; 445/23, 43, 44
See application file for complete search history.

(56) References Cited

U.S. PATENT DOCUMENTS 3,363,134 A 1/1968 Johnson
3,385,463 A 5/1968 Lange
3,519,406 A 7/1970 Hanneman et al.

(Continued)

FOREIGN PATENT DOCUMENTS

EP 0935278 8/1999

(Continued)

OTHER PUBLICATIONS

U.S. Appl. No. 10/323,252, filed Dec. 17, 2003, Bewlay et al.

(Continued)

*Primary Examiner*—Joseph L Williams
*Assistant Examiner*—Andrew J Coughlin
(74) *Attorney, Agent, or Firm*—Patrick K. Patnode

(57) ABSTRACT

A hermetically sealed lamp having at least one seal-material-free bond. The seal material-free bond may be a material diffusion bond, a mechanically deformed bond such as a cold weld or crimp, a focused heat bond such as a laser bond, or any other such bond. For example, the hermetically sealed lamp may have one or more endcaps diffusion bonded to an arc envelope, such as a ceramic tube or bulb. The hermetically sealed lamp also may have one or more tubular structures, such as dosing tubes, which are mechanically closed via cold welding or crimping. Localized heating, such as the heat provided by an intense laser, also may be used to enhance any of the foregoing bonds.

14 Claims, 9 Drawing Sheets

U.S. PATENT DOCUMENTS

| | | | | |
|---|---|---|---|---|
| 3,659,138 | A | | 4/1972 | Johnson et al. |
| 3,662,455 | A | | 5/1972 | Anderson |
| 3,693,007 | A | | 9/1972 | Kerekes |
| 3,872,341 | A | | 3/1975 | Werner et al. |
| 3,882,344 | A | | 5/1975 | Knochel et al. |
| 3,882,346 | A | | 5/1975 | McVey |
| 3,953,177 | A | | 4/1976 | Sedlatschek et al. |
| 4,011,480 | A | | 3/1977 | Jacobs et al. |
| 4,019,078 | A | | 4/1977 | Burgess |
| 4,065,691 | A | | 12/1977 | McVey |
| 4,103,200 | A | | 7/1978 | Bhalla |
| 4,155,758 | A | | 5/1979 | Evans et al. |
| 4,291,250 | A | | 9/1981 | Bhalla |
| 4,409,517 | A | | 10/1983 | Van Der Sande et al. |
| 4,464,603 | A | | 8/1984 | McVey |
| 4,507,584 | A | | 3/1985 | Coaton et al. |
| 4,545,799 | A | | 10/1985 | Rhodes et al. |
| 4,585,972 | A | | 4/1986 | Hing |
| 4,707,636 | A | | 11/1987 | Morris |
| 4,780,646 | A | | 10/1988 | Lange |
| 4,804,889 | A | | 2/1989 | Reid et al. |
| 5,057,048 | A | | 10/1991 | Feuersanger et al. |
| 5,095,246 | A | * | 3/1992 | Feuersanger et al. ..... 313/623 |
| 5,321,335 | A | | 6/1994 | Klug et al. |
| 5,404,077 | A | | 4/1995 | Eichelbronner et al. |
| 5,404,078 | A | | 4/1995 | Bunk et al. |
| 5,424,609 | A | | 6/1995 | Geven et al. |
| 5,426,343 | A | | 6/1995 | Rhodes et al. |
| 5,437,744 | A | | 8/1995 | Carlen |
| 5,484,315 | A | | 1/1996 | Juengst et al. |
| 5,552,670 | A | | 9/1996 | Heider et al. |
| 5,725,827 | A | | 3/1998 | Rhodes et al. |
| 5,783,907 | A | | 7/1998 | Suzuki et al. |
| 5,973,453 | A | | 10/1999 | Van Vliet et al. |
| 5,994,839 | A | | 11/1999 | Yamamoto et al. |
| 6,069,456 | A | | 5/2000 | Fromm et al. |
| 6,126,889 | A | | 10/2000 | Scott et al. |
| 6,215,254 | B1 | | 4/2001 | Honda et al. |
| 6,216,889 | B1 | | 4/2001 | Chang |
| 6,265,827 | B1 | | 7/2001 | Takahashi et al. |
| 6,294,871 | B1 | | 9/2001 | Scott et al. |
| 6,300,716 | B1 | | 10/2001 | Honda et al. |
| 6,375,533 | B1 | | 4/2002 | Torikai et al. |
| 6,404,129 | B1 | | 6/2002 | Hendricx et al. |
| 6,528,945 | B2 | | 3/2003 | Kelly et al. |
| 6,583,563 | B1 | | 6/2003 | Venkataramani et al. |
| 6,596,100 | B2 | | 7/2003 | Niimi |
| 6,635,993 | B1 | | 10/2003 | Niimi |
| 6,642,654 | B2 | | 11/2003 | Niimi |
| 6,657,388 | B2 | | 12/2003 | Wijenberg et al. |
| 6,750,612 | B2 | | 6/2004 | Takagaki et al. |
| 6,781,292 | B2 | | 8/2004 | Ishida et al. |
| 6,791,267 | B2 | | 9/2004 | Niimi |
| 6,812,642 | B1 | | 11/2004 | Niimi |
| 6,815,894 | B2 | | 11/2004 | Takagaki et al. |
| 6,873,109 | B2 | | 3/2005 | Ishigami et al. |
| 7,525,252 | B2 | | 4/2009 | Iorio et al. |
| 2002/0027421 | A1 | | 3/2002 | Kaneko et al. |
| 2002/0117965 | A1 | | 8/2002 | Kotter et al. |
| 2004/0108814 | A1 | | 6/2004 | Tsuda et al. |
| 2004/0119413 | A1 | | 6/2004 | Kebbede et al. |
| 2004/0119414 | A1 | | 6/2004 | Kebbede et al. |
| 2004/0124776 | A1 | | 7/2004 | Iorio |
| 2004/0135510 | A1 | | 7/2004 | Bewlay et al. |
| 2004/0174121 | A1 | | 9/2004 | Tsuda et al. |
| 2004/0183446 | A1 | | 9/2004 | Grundmann et al. |
| 2005/0007020 | A1 | | 1/2005 | Tsuda et al. |
| 2006/0001346 | A1 | | 1/2006 | Vartuli et al. |
| 2006/0008677 | A1 | | 1/2006 | Bewlay et al. |
| 2006/0012306 | A1 | | 1/2006 | Bewlay et al. |

FOREIGN PATENT DOCUMENTS

| | | |
|---|---|---|
| EP | 1111654 | 6/2001 |
| EP | 1150337 | 10/2001 |
| EP | 1158567 | 11/2001 |
| EP | 1172839 | 1/2002 |
| EP | 1172840 | 1/2002 |
| EP | 1220295 | 7/2002 |
| EP | 1253616 | 10/2002 |
| EP | 1296355 | 3/2003 |
| EP | 1351276 | 10/2003 |
| EP | 1363313 | 11/2003 |
| EP | 1434247 | 6/2004 |
| JP | 64-086061 | 3/1989 |
| JP | 06-096734 | 4/1994 |
| JP | 07-228940 | 8/1995 |
| JP | 2004214194 | 7/2004 |
| WO | WO9825294 | 6/1998 |
| WO | WO03/058674 | 7/2003 |
| WO | WO03099741 | 12/2003 |
| WO | WO2004023517 | 3/2004 |
| WO | WO2004049390 | 6/2004 |
| WO | WO2004049391 | 6/2004 |
| WO | WO2004051699 | 6/2004 |
| WO | WO2004051700 | 6/2004 |
| WO | WO2004102614 | 11/2004 |

OTHER PUBLICATIONS

U.S. Appl. No. 10/952,940, filed Sep. 29, 2004, Bewlay et al.
U.S. Appl. No. 10/984,593, filed Nov. 9, 2004, Loureiro et al.
U.S. Appl. No. 11/172,649, filed Jun. 30, 2005, Bewlay et al.
U.S. Appl. No. 11/172,650, filed Jun. 30, 2005, Bewlay et al.
U.S. Appl. No. 11/172,651, filed Jun. 30, 2005, Bewlay et al.
U.S. Appl. No. 11/289,128, filed Nov. 29, 2005, Bewlay et al.
Tokumatsu Tachiwaki et al., "*Novel Synthesis of $Y_3Al_5O_{12}$ (YAG) Leading to Transparent Ceramics*", Solid State Communications, vol. 119, pp. 603-606, 2001.
Lei Wen et al., "*Synthesis of Nanocrystalline Yttria Powder and Fabrication of Transparent YAG Ceramics*", Journal of the European Ceramic Society, vol. 24, pp. 2681-2688, 2003.
D. Hreniak et al., "*Synthesis and Optical Properties of $Nd^3$ + -Doped $Y_3Al_5O_{12}$ Nanoceramics*", Journal of Alloys and Compounds, vol. 341, pp. 183-186, 2002.
Guanshi Qin et al., "*Upconversion Luminescence of $Er^3$ + In Highly Transparent YAG Ceramics*", Solid State Communications, vol. 132, pp. 103-106, 2004.
Jianren Lu et al., "*Neodymium Doped Yttrium Aluminum Garnet ($Y_3Al_5O_{12}$) Nanocrystalline Ceramics—A New Generation of Solid State Laser and Optical Materials*", Journal of Alloys and Compounds, vol. 341, pp. 220-225, 2002.
A.K. Pradhan et al., "*Synthesis of Neodymium-Doped Yttrium Aluminum Garnet (YAG) Nanocrystalline Powders Leading to Transparent Ceramics*", Materials Research Bulletin, vol. 39, pp. 1291-1298, 2004.

* cited by examiner

HERMETICAL LAMP SEALING TECHNIQUES AND LAMP HAVING UNIQUELY SEALED COMPONENTS

CROSS REFERENCE TO RELATED APPLICATION

This application is a divisional of U.S. patent application Ser. No. 10/323,252, entitled "HERMETICAL LAMP SEALING TECHNIQUES AND LAMP HAVING UNIQUELY SEALED COMPONENTS", filed Dec. 18, 2002, which is herein incorporated by reference.

BACKGROUND

The present technique relates generally to the field of lighting systems and, more particularly, to high-intensity discharge (HID) lamps. Specifically, a hermetically sealed lamp is provided with improved sealing characteristics and resistance to corrosive dosing materials, such as halides and metal halides.

High-intensity discharge lamps are often formed from a ceramic tubular body or arc tube that is sealed to one or more endcaps. The endcaps are often sealed to this ceramic tubular body using a seal glass, which has physical and mechanical properties matching those of the ceramic components. Sealing usually involves heating the assembly of the ceramic tubular body, the endcaps, and the seal glass to induce melting of the seal glass and reaction with the ceramic bodies to form a strong bond. The ceramic tubular body and the endcaps are often made of the same material, such as polycrystalline alumina (PCA). However, certain applications may require the use of different materials for the ceramic tubular body and the endcaps. In either case, various stresses may arise from the sealing process, the interface between the joined components, and the materials used for the different components. For example, the component materials may have different mechanical and physical properties, such as different coefficients of thermal expansion (CTE), which can lead to residual stresses and sealing cracks. These potential stresses and sealing cracks are particularly problematic for high-pressure lamps.

The geometry of the interface between the ceramic tubular body and the endcaps also may attribute to the foregoing stresses. For example, the endcaps are often shaped as a plug or a pocket, which interfaces both the flat and cylindrical surfaces of the ceramic tubular body. If the components have different coefficients of thermal expansion and elastic properties, then residual stresses arise because of the different strains that prevent relaxation of the materials to stress free states. In the case of a plug-type endcap, the sealed interface between the ceramic tubular body and the endcaps restricts relaxation of the components in the axial, radial, and circumferential directions. If the endcaps and seal glass have a lower coefficient of thermal expansion than that of the ceramic tubular body, then stresses may develop as the endcaps and seal glass shrink less than the ceramic tubular body during the cooling portion of a sealing process.

In addition to the ceramic tubular body and endcaps, high-intensity discharge lamps also include a variety of internal materials (e.g., luminous gases) and electrode tips to create the desired high-intensity discharge for lighting. The particular internal materials (e.g., luminous gases) disposed in the high-intensity discharge lamps can affect the sealing characteristics, the light characteristics, and the type of materials that may be workable for the lamp components and the seal glass. For example, certain internal materials, such as halides and metal halides, may be desirable for lighting characteristics, while they are corrosive to some of the ceramic and metallic components that comprise the tubular body and endcap. Again, the corrosive nature of such internal materials may be particularly problematic for high-pressure lamps, which are relatively more sensitive to potential stresses and sealing cracks.

In certain applications, such as light projection requiring good optical control, existing high-intensity discharge lamps provide undesirable light and color characteristics. For example, existing high-intensity discharge lamps often have considerable light scattering, i.e., the apparent source size is too large, and insufficient red content of the light spectrum. The light scattering or source size is expressed quantitatively as the "etendue," while the lack of red content is expressed quantitatively by the "color efficiency" of the high-intensity discharge lamps. Both of these shortcomings limit the screen brightness of a projection system, such as a computer or video projection system.

Accordingly, a technique is needed to address one or more of the foregoing problems in lighting systems, such as high-intensity discharge lamps.

BRIEF DESCRIPTION

The present technique addresses one or more of the foregoing problems with a hermetically sealed lamp having at least one seal-material-free bond. The seal material-free bond may be a material diffusion bond, a mechanically deformed bond such as a cold weld or crimp, a focused heat bond such as a laser bond, or any other such bond. For example, the hermetically sealed lamp may have one or more endcaps diffusion bonded to an arc envelope, such as a ceramic tube or bulb. The hermetically sealed lamp also may have one or more tubular structures, such as dosing tubes, which are mechanically closed via cold welding or crimping. Localized heating, such as the heat provided by an intense laser, also may be used to enhance any of the foregoing bonds.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
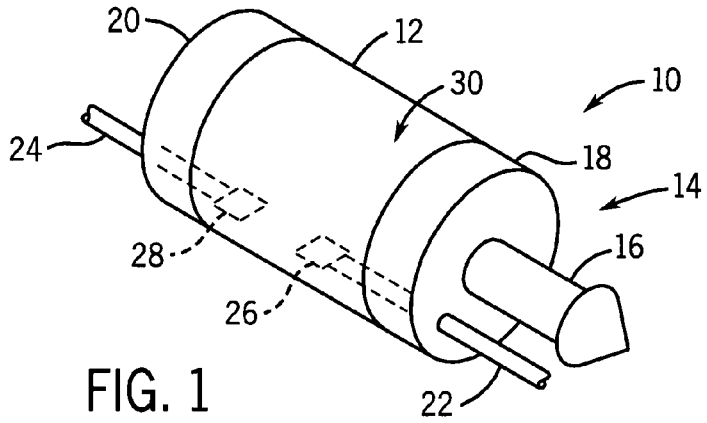
FIG. 1 is a perspective view of exemplary lamp 10 of the present technique.

As described in detail below, the present technique provides a variety of unique sealing systems and methods for reducing potential cracks and stresses within a lamp assembly, such as a high-intensity discharge lamp, thereby making the lamp operable at relatively higher temperatures and pressures exceeding typical operational conditions. For example, the lamp of the present technique may be operable at internal pressures exceeding 200 bars and internal temperatures exceeding 1000 Kelvins. In certain configurations, the present lamp may be operable at internal pressures exceeding 300 or 400 bars, while the internal temperature may exceed 1300 or 1400 Kelvins. The present lamp also may be workable at even higher temperatures and pressures, depending on the particular structural materials, internal materials (e.g., luminous gases), geometries, and so forth. In addition to the foregoing temperature and pressure conditions, the present lamp may be workable with a variety of corrosive internal materials, such as halide and metal halide dosing materials.

Some of the unique features that contribute to the present lamp's workability in the foregoing conditions include the use of material diffusion sealing techniques, non-thermal or room temperature sealing techniques, localized or focused heat sealing techniques, simplified seal interfaces, multi-region seal techniques, corrosion resistant materials, and so forth. For example, the components of the present lamp may be sealed together without using any seal material or interface substance, thereby eliminating one variable, i.e., the seal material, that often leads to stress and cracks. As discussed above, residual stresses and eventual cracks are often attributed to the different coefficients of thermal expansion (CTEs) of the various lamp components and the seal material. Accordingly, the components of the present lamp may be formed with compatible materials, which are capable of material diffusion without the addition of any interfacing or sealing material. Some components of the present lamp also may be formed from ductile materials, which can be sealed by mechanical deformation at room temperature. A variety of localized heating techniques, such as laser welding, also may be used to bond certain lamp components without thermally shocking or damaging the remaining components. Additionally, one or more bonds of the present lamp may have a simplified geometry, such as an end-to-end or butt-seal interface, rather than a multi-angled or stepped bond interface. This simplified geometry generally reduces the number of potential stresses, such as compressive and tensile stresses, associated with the different coefficients of thermal expansion and elasticity of the bonded components. Alternatively, if the lamp components have a stepped or angled seal interface, then the present technique may use different (or isolated) seal materials at the different angles/steps of the seal interface. As discussed in detail below, the lamp of the present technique may be formed from a variety of materials capable of sealing by the foregoing techniques, while also being able to withstand relatively high temperatures and pressures, corrosive materials such as halides, and so forth.

Although the present technique is applicable to a wide variety of lighting systems, the unique features introduced above are described with reference to several exemplary lamps illustrated in FIGS. 1-21. Turning now to these illustrations, FIG. 1 is a perspective view of an exemplary lamp 10 of the present technique. As illustrated, the lamp 10 comprises a hermetically sealed assembly of a hollow body or arc envelope 12, a dosing structure 14 having a dosing tube 16 extending through an endcap 18, and an endcap 20. The lamp 10 also has lead wires 22 and 24 extending through (or from) the endcaps 18 and 20 into the arc envelope 12, where the lead wires 22 and 24 terminate at arc electrodes or tips 26 and 28. An internal lighting or dosing material 30 also may be disposed inside the hermetically sealed assembly.

As discussed in further detail below, the foregoing lamp components may be bonded or sealed together by a variety of techniques. For example, the endcaps 18 and 20 may be sealed to opposite ends of the arc envelope 12 by one or more seal materials, a material diffusion or cosintering process, localized heating, and so forth. Similarly, the dosing tube 16 and the lead wires 22 and 24 can be bonded to the respective endcaps 18 and 20 by one or more seal materials, material diffusion, localized heating, and so forth. After injecting the dosing material 30 into the arc envelope 12, the dosing tube 16 may be sealed via localized heating, cold welding, crimping, or any other desired sealing technique.

The lamp 10 may comprise a variety of lamp configurations and types, such as a high intensity discharge (HID) or ultra high intensity discharge (UHID) lamp. For example, the lamp 10 may be a high pressure sodium (HPS) lamp, a ceramic metal halide (CMH) lamp, a short arc lamp, an ultra high pressure (UHP) lamp, a projector lamp, and so forth. As mentioned above, the lamp 10 of the present technique is uniquely sealed to accommodate relatively extreme operating conditions. Externally, the lamp 10 may be capable of operating in a vacuum, nitrogen, air, or various other gases and environments. Internally, the lamp 10 may retain pressures exceeding 200, 300, or 400 bars and temperatures exceeding 1000, 1300, or 1400 Kelvins. For example, certain configurations of the lamp 10 may operate at internal pressure of 400 bars and an internal temperature at or above the due point of mercury at 400 bars, i.e., approximately 1400 Kelvins. These higher internal pressures are also particularly advantageous to short arc lamps, which may be capable of producing a shorter arc as the internal lamp pressure increases. Depending on the particular application, the lamp 10 also may hermetically retain a variety of dosing materials 30, such as luminous gases. For example, the dosing material 30 may comprise a rare gas and mercury. The dosing material 30 also may include a halide (e.g., bromine, iodine, etc.), a rare earth metal halide, and so forth.

The components of the lamp 10 can be formed from a variety of materials, which may be the same or different from one another. For example, the arc envelope 12 may be a transparent or translucent ceramic bulb, cylinder, or any other suitable hollow body. The arc envelope 12 may be formed from a variety of materials, such as yttrium-aluminum-garnet, ytterbium-aluminum-garnet, microgram polycrystalline alumina (μPCA), alumina or single crystal sapphire, yttria, spinel, ytterbia, and so forth. The arc envelope 12 also may be formed from other common lamp materials, such as polycrystalline alumina (PCA), but the foregoing materials advantageously provide lower light scattering and other desired characteristics.

The endcaps 18 and 20 also may be formed from a variety of materials, such as niobium, niobium coated with a corrosion resistant material (e.g., a halide resistant material), a cermet (e.g., an alumina-molybdenum, a molybdenum-zirconia, or a molybdenum-yttria-stabilized-zirconia), or any other suitable material. Niobium has a coefficient of thermal expansion that is close to that of useful ceramics, plus it is thermochemically stable against hot sodium and mercury vapor. Accordingly, niobium may be sufficient for some applications. However, if a corrosive material such as halide is disposed within the lamp 10, then a corrosion resistant material may be desirable. For example, the corrosion resistant material may comprise molybdenum, which is particularly resistant to hot halide vapor. In one embodiment, the endcaps 18 and 20 comprise a niobium plate coated with a thin layer of molybdenum. The thin layer is sufficiently thin to minimize the mismatch in the coefficients of thermal expansion between molybdenum and the ceramic, thereby reducing the likelihood of eventual ceramic stress and cracking. A cermet, such as an a alumina-molybdenum, a molybdenum-zirconia, or a molybdenum-yttria-stabilized-zirconia, also may be particularly advantageous for the lamp 10. For example, a cermet can be engineered with a good CTE match with the ceramic arc envelope 12, while also being resistant to hot halide vapors. An exemplary molybdenum-zirconia cermet may have a composition of 35 to 70 percent by volume of zirconia. In certain embodiments, the molybdenum-zirconia cermet may comprise a 55 to 65 percent volume of zirconia. However, any other suitable molybdenum-zirconia composition is within the scope of the present technique.

Regarding the electrical components of the lamp 10, the lead wires 22 and 24 may penetrate the endcaps 18 and 20 if the endcap materials are not conducting. However, if the endcap material is electrically conductive, then the lead wires 22 and 24 can be mounted directly to the endcaps 18 and 20 rather than passing through them. The lead wires 22 and 24 may comprise any suitable materials, such as tungsten or molybdenum. These lead wires 22 and 24 can then be diffusion bonded to the endcaps, dosing tubes, and so forth. For example, a tungsten-cermet diffusion bond or molybdenum diffusion bond may be formed between the respective components. Similarly, the electrode tips 26 and 28 may comprise tungsten or any other suitable material.

The dosing tube 16 also may have a variety of configurations and material compositions, such as niobium. However, in the present technique, it is desirable to provide stability at high temperatures and pressures, stability against corrosive materials such as hot halide vapors, and ductility for cold welding the dosing tube 16. For example, the dosing tube 16 may be formed from an alloy of molybdenum and rhenium, both of which are stable against hot halides. Although any suitable composition is within the scope of the present technique, an exemplary molybdenum-rhenium alloy may comprise 35 to 55 percent weight of rhenium. In certain embodiments, the molybdenum-rhenium alloy may comprise a 44 to 48 percent weight of rhenium. However, any other suitable molybdenum-rhenium composition is within the scope of the present technique. Alloys of molybdenum and rhenium are also sufficiently ductile to allow the dosing tube 16 to be hermetically sealed via a crimping process, a cold welding process, or any other suitable mechanical deformation technique. The dosing tube 16 also can be sealed by a series of cold welding steps, localized heating steps, and so forth. However, the initial hermetic seal of the dosing tube 16, i.e., via cold welding, can be made without unduly heating the volatile components of the dosing materials 30 within the arc envelope 12 and without thermally shocking the arc envelope 12 and the other components of the lamp 10. If desired, the present technique may utilize localized heating to facilitate a stronger seal of the dosing tube 16. For example, if a crimping tool is used to provide the cold weld, then the crimp jaws of the tool may be heated to facilitate the bond. Moreover, localized heating may be subsequently applied to the initial cold weld to ensure that the hermetically sealed dosing tube 16 can withstand higher pressures, such as internal pressures exceeding 200, 300 or 400 bars. Laser welding is one exemplary localized heating technique.

As discussed above, the dosing tube 16 of the dosing structure 14 enables the volume of the arc envelope 12 to be evacuated and back filled with the desired dosing material 30, such as a rare gas, mercury, halides, and metal halides. As discussed in further detail below, the evacuation and back fill process may be performed by simply attaching the dosing tube 16 to a suitable processing station, as opposed to handling the assembly in a dry box and/or furnace. This is particularly advantageous when the room temperature rare gas pressure in the arc envelope 12 is substantially above one bar.

Regarding lamp assembly, the hermetically sealed assembly of the arc envelope 12, the endcaps 18 and 20, the dosing tube 16 and the lead wires 22 and 24 may be sealed using a variety of sealing techniques. These sealing techniques may range from seal materials, seal-material-free bonding techniques, simplified geometrical seal interfaces (e.g., end-to-end or butt-sealing), and so forth. For example, a sealing material, such as glass or braze, may be disposed between the components and heated to join the components together. The heating may be applied by a variety of non-localized and localized heating techniques, ranging from a furnace to a laser. The sealing materials may comprise a sealing glass, such as calcium aluminate, dysprosia-alumina-silica, magnesia-alumina-silica, and yttria-calcia-alumina. Other potential non-glass materials may include niobium-based brazes or any other suitable material. The calcium aluminate material may be capable of high temperature operation (e.g., up to approximately 1500 Kelvins), while it is also halide resistant. The other sealing glasses also may be capable of high temperature operation (e.g., up to approximately 1500 Kelvins).

In alternative to the foregoing seal materials, the hermetically sealed assembly of the lamp 10 may be formed without any sealing glass or braze material between the individual components, i.e., a seal-material-free bond. For example, the adjacent components may be directly bonded together via diffusion or cosintering. If the adjacent components comprise molybdenum, then the components may be joined via molybdenum diffusion. For example, if the lamp 10 comprises molybdenum lead wires 22 and 24, endcaps 18 and 20 formed by an alumina-molybdenum or molybdenum-zirconia cermet, and a molybdenum-yttria dosing tube 16, then the components may be thermally bonded together via molybdenum diffusion of the molybdenum in each adjacent component. Another example is a sapphire or yttrium-aluminum-garnet (YAG) arc envelope 12, which can be co-sintered and diffusion-bonded to yield a hermetic bond to molybdenum-zirconia (e.g., yttria-stabilized) cermet endcaps 18 and 20 via diffusion of the aluminum and zirconia across the joint. Alternatively, the bond may be formed between YAG and alumina-molybdenum or a suitable metal-cermet interface. Other materials also may be used to facilitate the foregoing diffusion or cosintering across the adjacent components of the lamp 10. In addition, a variety of focused or localized heating techniques (e.g., a laser) can be used to provide the foregoing seal-material-free bonding of the various components of the lamp 10. As mentioned above, the exclusion of the seal material eliminates its associated problems, such as seal cracks and stresses arising from the different coefficients of thermal expansion between the seal material and lamp components. Given the susceptibility of some seal materials to corrosive dosing materials 30, such as halides and metal halides, the foregoing seal-material-free bonding techniques further improve the lamp 10 for operation with such corrosive materials.

The present technique also may include modified structural interfaces between the components to reduce potential stresses and seal cracks. For example, a multi-angled or multi-stepped seal interface can be altered to provide fewer interface orientations, thereby reducing the potential for tensile and/or compressive stresses to develop between the components. This is particularly advantageous for components having different coefficients of thermal expansion. For example, the arc envelope 12 and the endcaps 18 and 20 may be sealed end-to-end, i.e., butt-sealed, to reduce the likelihood of the foregoing stresses and seal cracks.

Figure 2:
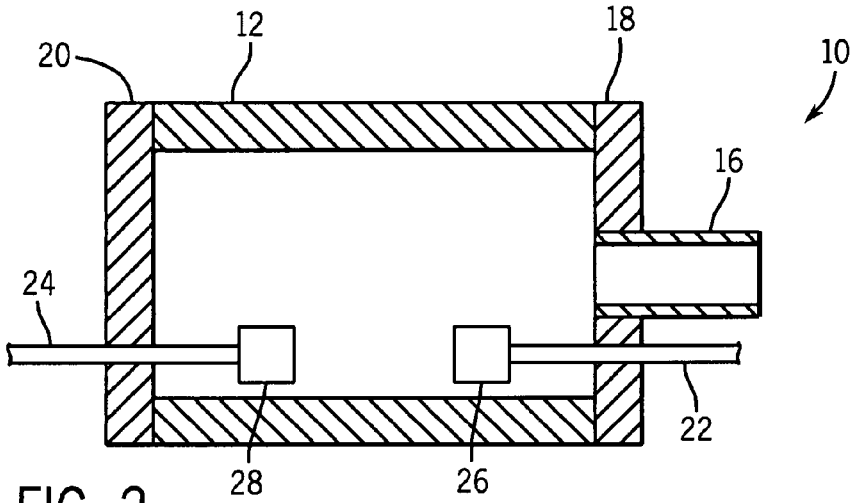
FIG. 2 is a cross-sectional side view of the lamp illustrated in FIG. 1 illustrating a hermetically sealed lamp assembly of an arc envelope, endcaps, and a dosing tube.

In view of the foregoing unique features and materials, various embodiments of the lamp 10 are discussed with reference to FIGS. 2-21. FIG. 2 is a cross-sectional side view of the lamp 10 illustrating an exemplary end-to-end or butt-seal between the endcaps 18 and 20 and the opposite ends of the arc envelope 12. As illustrated, the endcaps 18 and 20 do not extend into or around the circumference of the arc envelope 12. By reducing the seal interface to a single plane, i.e., the abutted end surfaces, the butt-seal effectively reduces the stresses and cracks generally associated with multi-angled or multi-step seal interfaces. This butt-sealing technique can be used with any lamp configuration or type, such as lamps having one or more open ends that can be sealed with an endcap.

Figure 3:
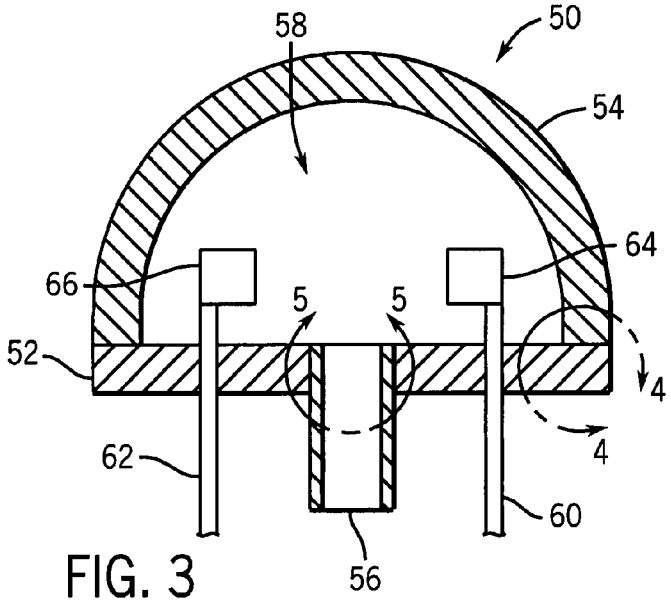
FIG. 3 is a cross-sectional side view of an alternate embodiment of the lamp.

FIG. 3 is a cross-sectional side view of an alternative lamp 50, which comprises a single endcap 52 butt-sealed to a hollow body or arc envelope 54. As described above, the present technique may utilize any suitable joining or sealing mechanisms, including a sealing material, cosintering, localized heating, induction heating, and so forth. Similar to the lamp 10 illustrated in FIG. 1, the lamp 50 also includes a dosing tube 56 extending through the endcap 52 into the arc envelope 54, such that a dosing material 58 can be injected into the lamp 50. The illustrated lamp 50 also includes lead wires 60 and 62 extending to arc electrodes or tips 64 and 66 within the arc envelope 54. Again, as described above, the lamps 10 and 50 described with reference to FIGS. 1, 2, and 3 may be formed from any of the materials and sealing processes noted above and described in further detail below.

Figure 4:
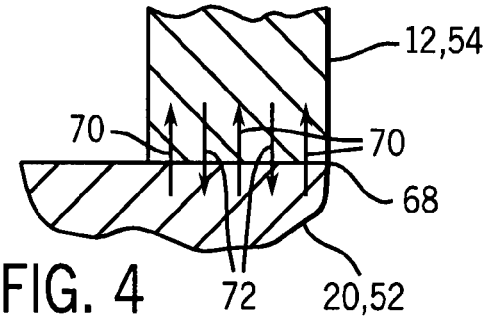
FIG. 4 is a close-up cross-sectional view illustrating an exemplary material-diffusion butt-joint of the arc envelopes and endcaps illustrated in FIGS. 2 and 3.

FIG. 4 is a cross-sectional side view of one of the butt-seals illustrated in FIGS. 2 and 3. As illustrated, a material-diffusion butt-seal 68 between the endcap 20, 52 and the arc envelope 12, 54 is achieved via cosintering or diffusion of the adjacent materials, as indicated by arrows 70 and 72. For example, an endcap 20, 52 formed of molybdenum-zirconia (e.g., yttria stabilized) cermet may be thermally bonded with an arc envelope 12, 54 formed of alumina (e.g., a single crystal sapphire) via diffusion of the alumina and zirconia between the two components to create the seal 68. Alternatively, an endcap 20, 52 formed of an alumina-molybdenum cermet may be thermally bonded with an arc envelope 12, 54 formed of alumina (e.g., a single crystal sapphire) via diffusion of the alumina between the two components to create the seal 68. This cosintering or diffusion bonding may be used for any structural configuration of the endcaps and arc envelopes and, also, for bonding various other components of the lamp 10.

Figure 5:
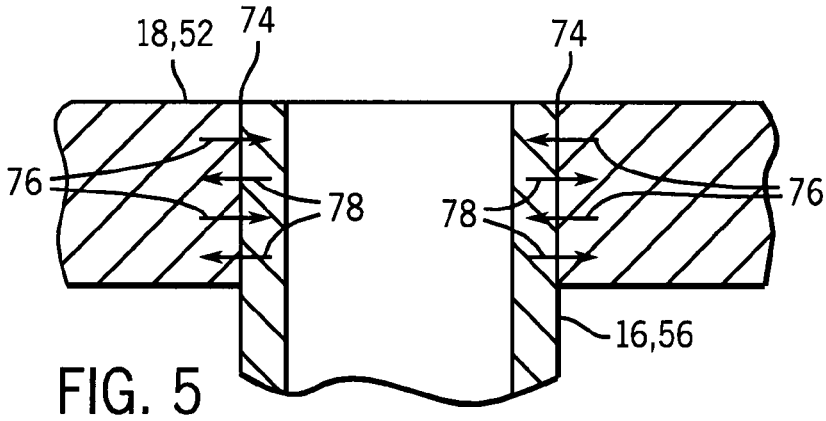
FIG. 5 is a close-up cross-sectional view illustrating an exemplary material-diffusion joint coupling the endcaps and dosing tubes illustrated in FIGS. 2 and 3.

For example, FIG. 5 illustrates diffusion bonding of the dosing tube 16, 56 with the endcap 18, 52, as illustrated in FIGS. 2 and 3. As illustrated, a material-diffusion bond or seal 74 between the endcap 18, 52 and the dosing tube 16, 56 is achieved via cosintering or diffusion of the adjacent materials, as indicated by arrows 76 and 78. For example, an endcap 18, 52 formed of an alumina-molybdenum or molybdenum-zirconia (e.g., yttria-stabilized) cermet may be thermally bonded with a dosing tube 16, 56 formed of molybdenum-rhenium alloy via diffusion of the molybdenum between the two components to create the material-diffusion bond or seal 74. This cosintering or diffusion bonding may be used for any structural configuration of the dosing tube, including a configuration in which the dosing tube is coupled directly to the arc envelope rather than through an endcap.

Figure 6:
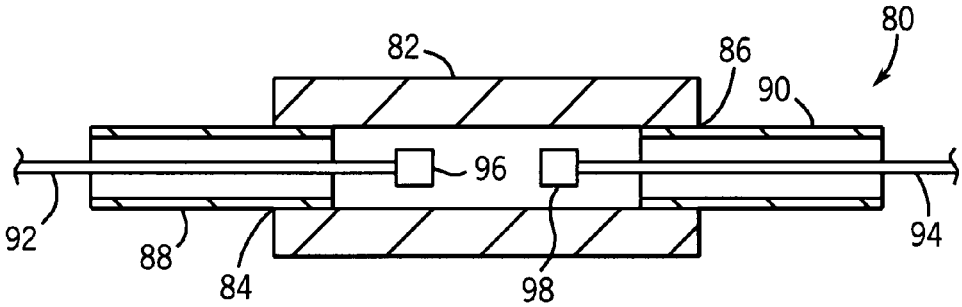
FIGS. 6-8 are cross-sectional side views of further alternate embodiments of the lamp having one or more dosing tubes coupled to various arc envelopes.
Figure 7:
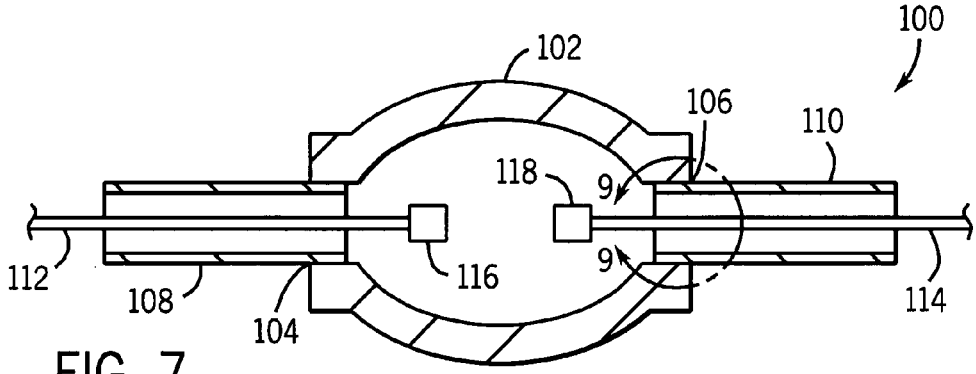
Figure 8:
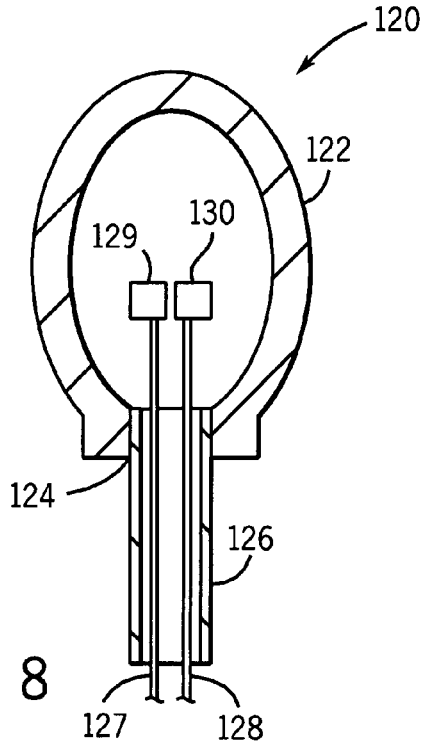

FIGS. 6-8 are cross-sectional side views of further alternate embodiments of the lamp 10 having one or more dosing tubes coupled to various arc envelopes. In these alternative embodiments, the illustrated arc envelopes may have one or more receptacles in which the dosing tubes are directly sealed via a seal material, material-diffusion, localized heating, or any other desired technique. For example, FIG. 6 is a cross-sectional side view illustrating an alternative lamp 80 having a cylindrical hollow body or arc envelope 82, which has opposite receptacles or open ends 84 and 86. During assembly, dosing tubes 88 and 90 are fitted into these open ends 84 and 86 and subsequently bonded to form a hermetic seal with the arc envelope 82. Additionally, lead wires 92 and 94 supporting arc electrodes or tips 96 and 98 may be disposed into the arc envelope 82 through the dosing tubes 88 and 90. It should be noted that an overwind of wire (or filler material) may be disposed about the lead wires 92 and 94 in the dosing tubes 88 and 90 to facilitate better mechanical and/or thermal contact between the components. However, any suitable configuration is within the scope of the present technique. The entire assembly process of the lamp 80 is illustrated in further detail below with reference to FIGS. 9-14.

As illustrated in FIG. 7, an alternative lamp 100 is provided with a generally round (e.g., oval, spherical, oblong, etc.) hollow body or arc envelope 102, which has opposite receptacles or open ends 104 and 106. Again, dosing tubes 108 and 110 are fitted into these open ends 104 and 106 and subsequently bonded to form a hermetic seal with the arc envelope 102. Additionally, lead wires 112 and 114 supporting arc electrodes or tips 116 and 118 may be positioned in the arc envelope 102 via a crimp attachment of the dosing tubes 108 and 110. Again, the entire assembly process of the lamp 100 can be understood with reference to FIGS. 9-14.

FIG. 8 illustrates another alternative lamp 120 having a generally round (e.g., oval, spherical, oblong, etc.) hollow body or arc envelope 122, which has a single receptacle or open end 124. In the illustrated embodiment, a single dosing tube 126 is fitted into the open end 124 and subsequently bonded to form a hermetic seal with the arc envelope 122. Additionally, lead wires 127-128 supporting arc electrodes or tips 129-130 may be disposed into the arc envelope 122 through the dosing tube 126. Again, the entire assembly process of the lamp 100 can be understood with reference to FIGS. 9-14.

Figure 9:
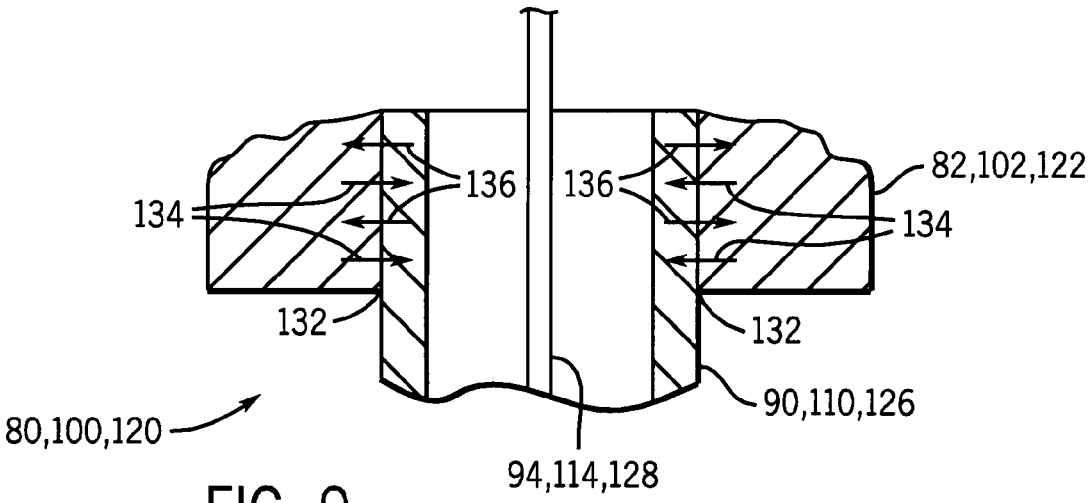
FIG. 9 is a close-up cross-sectional view illustrating an exemplary material diffusion joint coupling the various arc envelopes and dosing tubes illustrated in FIGS. 6-8.

As mentioned above, the dosing tubes 80, 100, and 120 may be coupled to their respective arc envelopes 82, 102, and 122 by a variety of sealing mechanisms, such as one or more seal materials, localized heating techniques, diffusion or cosintering techniques, and so forth. For example, a seal glass frit or niobium-based braze may be disposed at the interface between these dosing tubes 80, 100, and 120 and their respective arc envelopes 82, 102, and 122. A hermetic seal can then be formed by either heating the entire lamp or by locally heating the interface region. Alternatively, a seal-material-free bond may be formed between the dosing tubes 80, 100, and 120 and their respective arc envelopes 82, 102, and 122. FIG. 9 is a close-up cross-sectional view illustrating an exemplary material-diffusion seal 132 coupling the respective dosing tubes 80, 100, and 120 with the arc envelopes 82, 102, and 122 illustrated in FIGS. 6-8. Although a variety of materials may be used for these arc envelopes and dosing tubes, the material diffusion between the respective dosing tubes 80, 100, and 120 and the arc envelopes 82, 102, and 122 is illustrated generally with reference to arrows 134 and 136.

Figure 10:
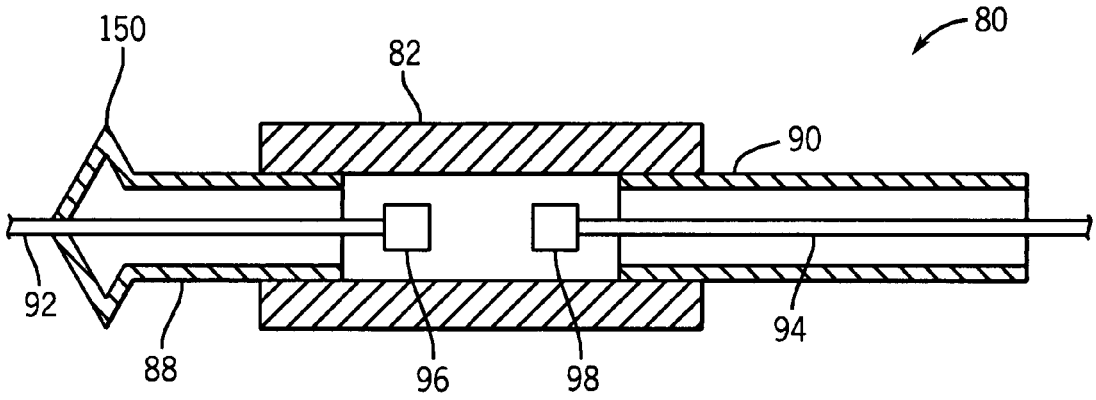
FIGS. 10-13 are cross-sectional side views of the lamp illustrated in FIG. 6 further illustrating a material dosing and sealing process of the lamp.
Figure 13:
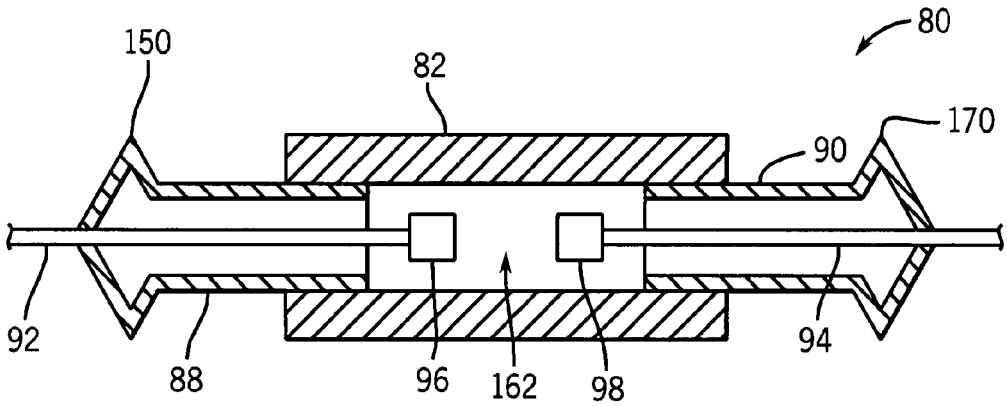
Figure 11:
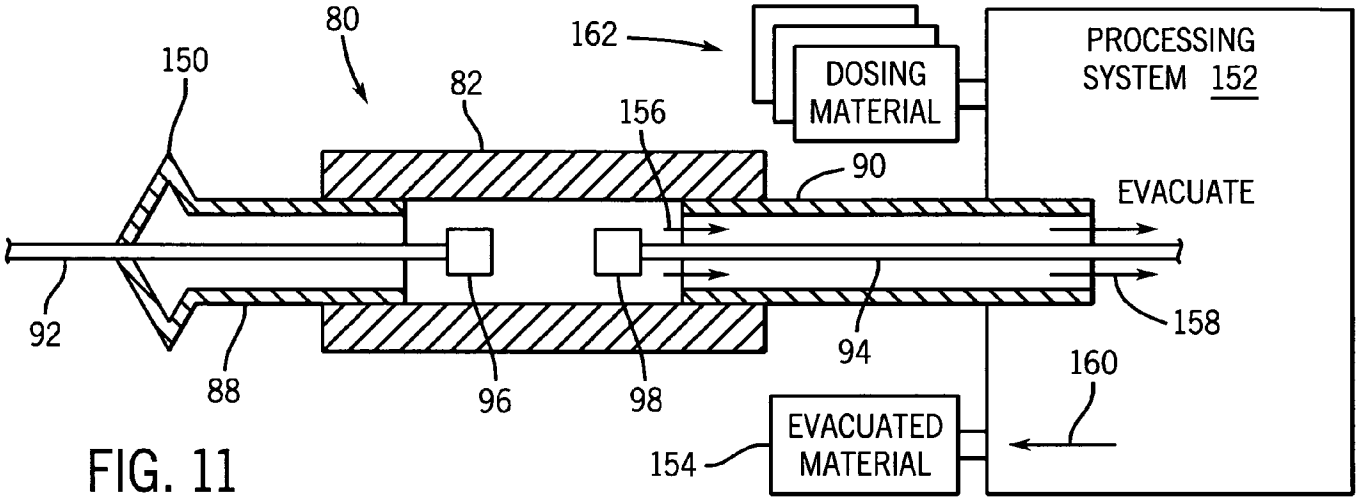
Figure 12:
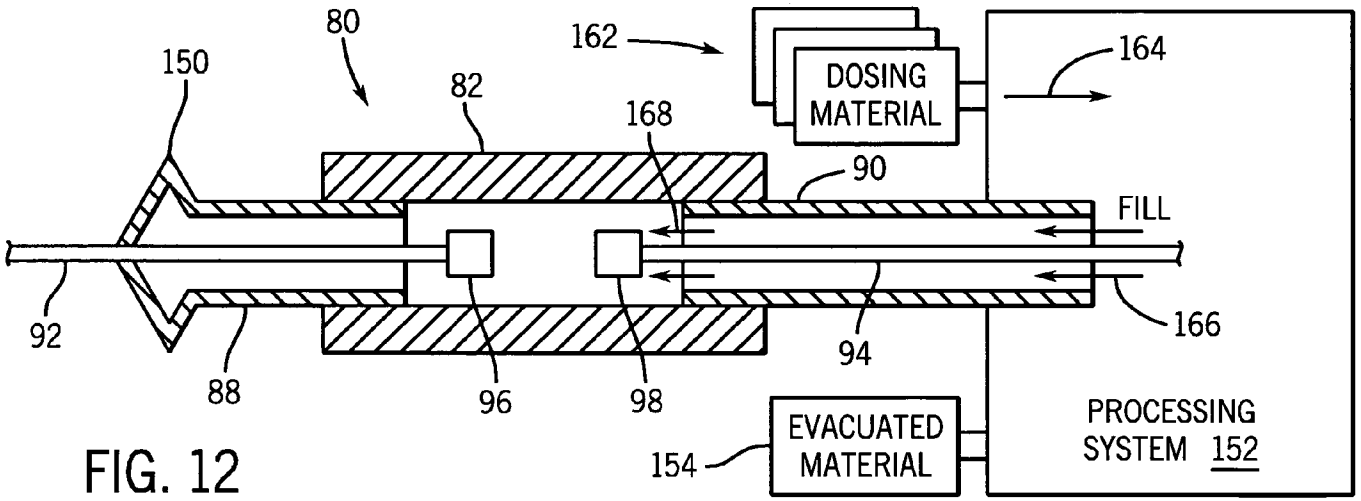

After assembling the dosing tubes 80, 100, and 120 with the respective arc envelopes 82, 102, and 122, the present technique proceeds to seal, evacuate, and dose the respective lamps 80, 100, and 120 with the desired dosing materials. FIGS. 10-13 are cross-sectional side views of the lamp illustrated in FIG. 6 further illustrating a material dosing and sealing process of the lamp. However, the process is also applicable to other forms of lamps, such as those illustrated in FIGS. 1-5. In the illustrated embodiment, the lamp 80 has two dosing tubes 88 and 90, only one of which is needed for injecting the dosing material into the lamp 80. Accordingly, as illustrated in FIG. 10, the dosing tube 88 is closed via a cold welding or crimping operation to form a hermetical seal 150. For example, the dosing tube 88 may embody a niobium or molybdenum-rhenium alloy, which is mechanically compressed via a crimping tool or other mechanical deformation tool. If desired, heat can also be applied (e.g., a laser weld) to facilitate a stronger bond at the hermetical seal 150. Once sealed, the lamp 80 may be coupled to one or more processing systems, such as processing system 152, to provide a desired lighting substance in the lamp 80. In the illustrated embodiment of FIG. 11, the processing system 152 operates to evacuate any substances 154 currently in the arc envelope 82, as indicated by arrows 156, 158, and 160. Once evacuated, the processing system 152 proceeds to inject one or more dosing materials 162 into the arc envelope 82, as illustrated by arrows 164, 166, and 168 in FIG. 12. For example, the dosing materials may comprise a rare gas, mercury, a halide, and so forth. Moreover, the dosing materials 162 may be injected into the arc envelope 82 in the form of a gas, a liquid, or a solid, such as a dosing pill. After the desired dosing materials have been injected into the lamp 80, the present technique proceeds to close the remaining dosing tube 90, as illustrated in FIG. 13. For example, as described above, the dosing tube 90 may embody a niobium or molybdenum-rhenium alloy, which is mechanically compressed via a crimping tool or other mechanical deformation tool to form a hermetical seal 170.

Figure 14:
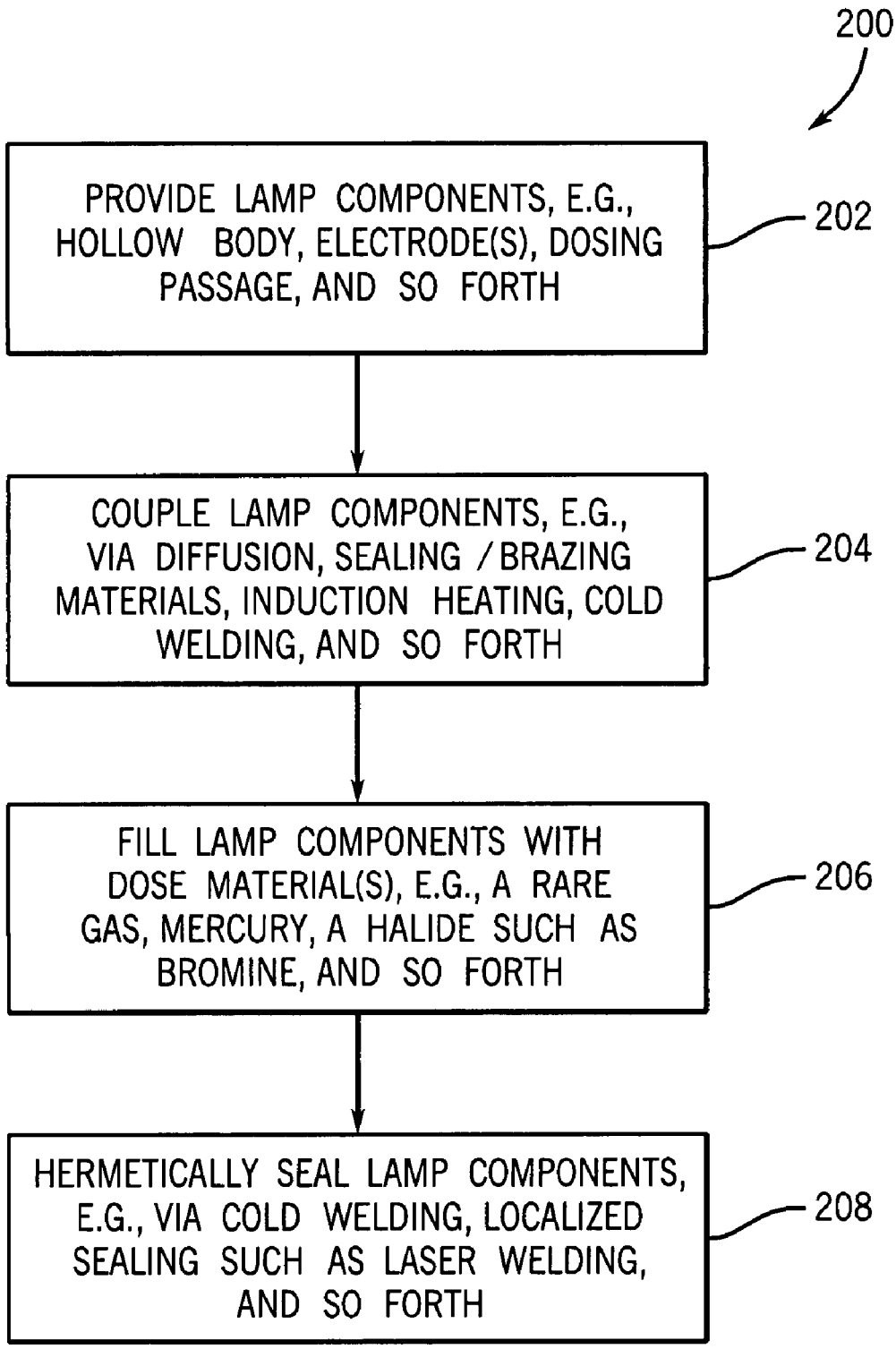
FIG. 14 is a flowchart illustrating the lamp assembly, dosing, and sealing process depicted structurally in FIGS. 1-13.

FIG. 14 is a flowchart illustrating an exemplary lamp assembly, dosing, and sealing process 200, which may be understood with reference to the various lamp embodiments of FIGS. 1-13. As illustrated, the process 200 proceeds by providing a variety of lamp components, such as a hollow body or arc envelope, one or more electrodes or arc tips having a lead, one or more dosing passages, and one or more endcaps depending on the particular embodiment (block 202). It should be noted that one or more of these components may be standard or custom components, which are either purchased, formed in house, tailored to a particular lamp, or obtained by other means. For example, the electrodes or arc tips may be purchased from one or more outside vendors, while the arc envelope or dosing passages can be manufactured in-house using the desired materials. Any of the materials and structures described above may be used for the lamp components provided in block 202.

After obtaining, manufacturing, or generally providing the desired lamp components, the process 200 proceeds to couple lamp components together via material diffusion, sealing/brazing materials, induction heating, cold welding, crimping, simplified geometrical interfaces, and so forth (block 204). For example, the process 200 may assemble an arc envelope, one or more endcaps, and one or more dosing tubes, as illustrated in FIGS. 2-3 and 6-8. If the assembled lamp has multiple dosing tubes, such as FIGS. 6-8, then the process 200 may also proceed to close all but one of the dosing tubes via mechanical deformation, localized heating, or any other suitable sealing technique (see FIGS. 10-12). The process 200 then proceeds to fill the lamp components (e.g., the hermetically sealed arc envelope and dosing tube) with a desired dose material, such as a rare gas, mercury, a halide such as bromine or iodine, and/or a metal halide (block 206). The dosing step 206 may be performed with any suitable processing system, such as the processing system 152 described with reference to FIGS. 10-12. As noted above, these dosing materials may be in a gaseous state, a fluid state, or a solid state (e.g., a pill, powder, etc.). Moreover, each individual substance may be injected separately or jointly with other substances into the lamp components. The lamp components also may be evacuated prior to dosing with the foregoing materials. After internal processing, the lamp components, i.e., the dosing passage, may be hermetically sealed via cold welding, localized sealing such as laser welding, crimping, and so forth (block 208). As a result of these techniques, the lamp produced by the process 200 may have a variety of unique sealing characteristics, corrosion resistance, workability at high internal temperatures and pressures, and reduced susceptibility to stress and cracks.

As discussed in further detail below with reference to FIGS. 15-21, the present technique also may comprise a variety of lamps having seal material bonds, which can be combined with one or more of the foregoing seal-material-free bonds. In each of these embodiments, the arc envelope, dosing tubes, and endcaps may comprise a variety of materials. For example, the various lamps can be formed from a sapphire tubular arc envelope bonded with a polycrystalline alumina (PCA) endcap. At the various bonding interfaces between the lamp components, the present technique may apply a seal material (e.g., a seal glass or niobium braze) having a desired coefficient of thermal expansion (CTEs) to control stresses at each PCA/sapphire seal interface. For example, the different seal materials may include a seal glass that minimizes tensile stresses developed upon cooling, e.g., a seal glass with a CTE value that is the average value of PCA and the ab-radial value of sapphire. Localized heating also may be used to control the local microstructural development of the seal material, e.g., the seal glass. Moreover, the seal material may be applied to select areas of the seal interface (e.g., the PCA/sapphire interface), while leaving other interfaces seal-material-free. The seal interface also may include one or more seal materials having a negative coefficient of thermal expansion (i.e., the seal material expands upon cooling). Such a seal material could keep the seal interfaces under compression, thereby improving the seal between the lamp components.

Figure 15:
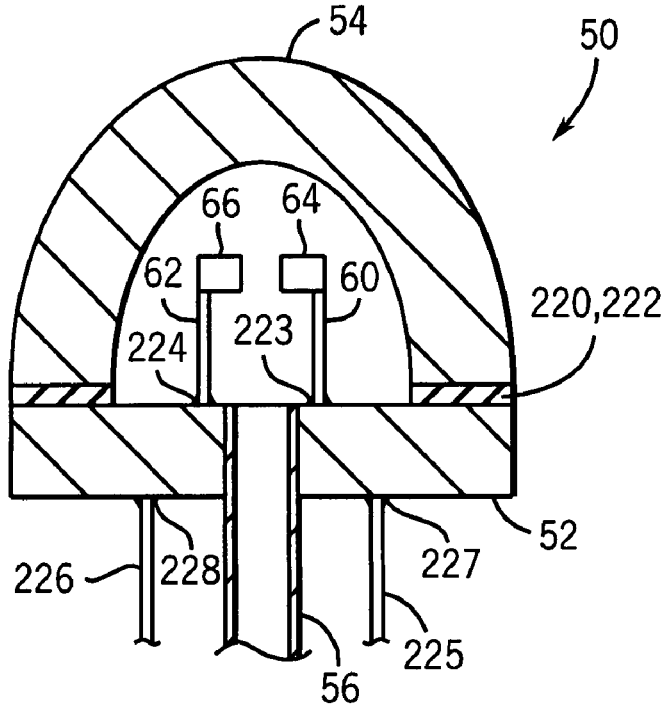
FIG. 15 is a cross-sectional side view of an alternative embodiment of the lamp illustrated in FIG. 3 further illustrating an exemplary butt-seal of the arc envelope with the endcap via a seal material.

Turning now to FIGS. 15-21, various embodiments will be described in light of the foregoing discussion. FIG. 15 is a cross-sectional side view of an alternative embodiment of the lamp 50 illustrated in FIG. 3. As illustrated, the lamp 50 has an exemplary end-to-end or butt-seal 220 between the arc envelope 54 and the endcap 52 via a seal material 222. In this exemplary embodiment, the lead wires 60 and 62 are bonded to the endcap 52 via bonds 223 and 224, rather than extending through the endcap 52 as illustrated in FIG. 3. The lead wires 60 and 62 also may extend partially through the endcap 52. These alternative lead wire configurations can be used to avoid lead wire sealing issues in the endcap 52. Accordingly, if the endcap 52 comprises a conductive material, such as a metal or an electrically conducting cermet, then the lead wire can simply attach to (or extend partially into) opposite sides of the endcap 52. Given the conductivity of the endcap 52, lead wires 225 and 226 can be bonded to the external side of the endcap 52 at any location via bonds 227 and 228, respectively.

Figure 16:
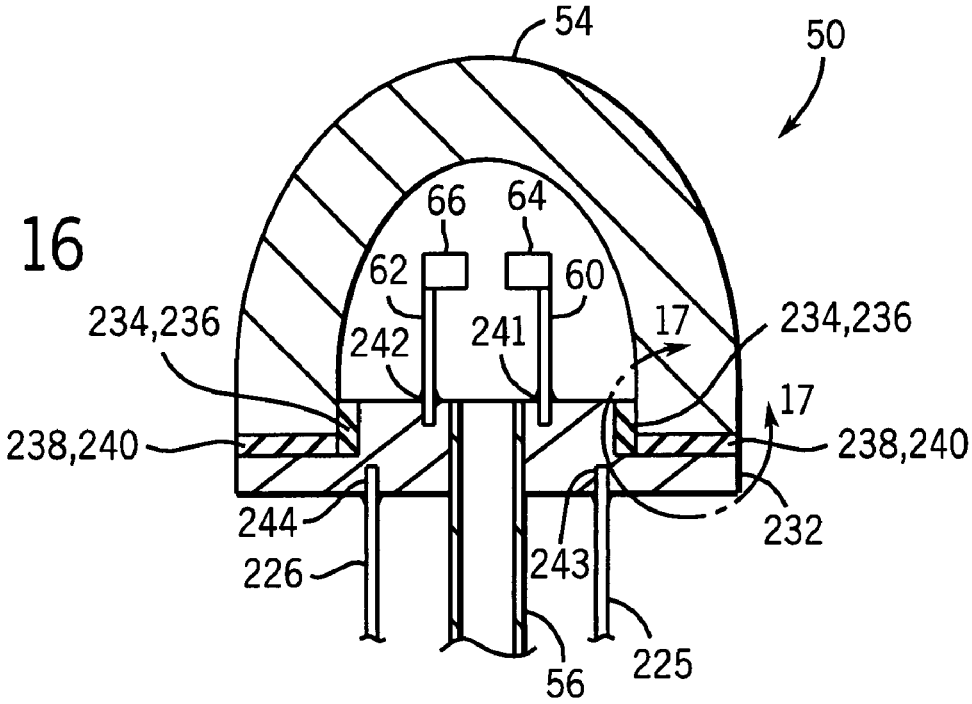
FIG. 16 is a cross-sectional side view of another alternative embodiment of the lamp illustrated in FIG. 3 having a stepped-endcap.

FIG. 16 is a cross-sectional side view of another alternative embodiment of the lamp 50 illustrated in FIG. 3. Here, the lamp 50 has an exemplary multi-seal-material joint 230 between the arc envelope 54 and a stepped-endcap 232. Although a particular structure is illustrated, the stepped endcap 232 may include any endcap having multiple sealing interfaces, such as an angled interface (e.g., 90 degrees), a U-shaped or slot-shaped interface, and so forth. In this exemplary embodiment, the materials of the arc envelope 54 and the stepped-endcap 232 may be selected with different coefficients of thermal expansion, such that the arc envelope 54 compresses or shrink-fits onto the stepped endcap 232. Moreover, multiple seal materials may be used to better accommodate the different coefficients of thermal expansion along the stepped interface between the arc envelope 54 and the stepped endcap 232. For example, the multi-seal-material joint 230 may comprise a seal material 234 along an inner circular interface 236, while another seal material 238 is disposed along an end interface 240 of the arc envelope 54. An isolating material also can be disposed between the two seal materials 234 and 238 to maintain their isolation from one another. Moreover, localized heating can be applied to one of the seal materials (e.g., seal material 234) prior to curing the other seal material (e.g., seal material 238). If this multi-step curing process is used to cure the multi-seal-material joint 230, then the seal materials 234 and 238 may comprise the same sealing substance. Additional configurations of the multi-seal-material joint 230 are illustrated with reference to FIGS. 17-19. It also should be noted that the lead wires 60-62 and 225-226 illustrated in FIG. 16 are extended partially into the stepped-endcap 232 via bonds 241-242 and 243-244, rather than bonding to the surfaces or extending entirely through the stepped-endcap 232. Again, any other configuration of the lamp components is within the scope of the present technique.

Figure 17:
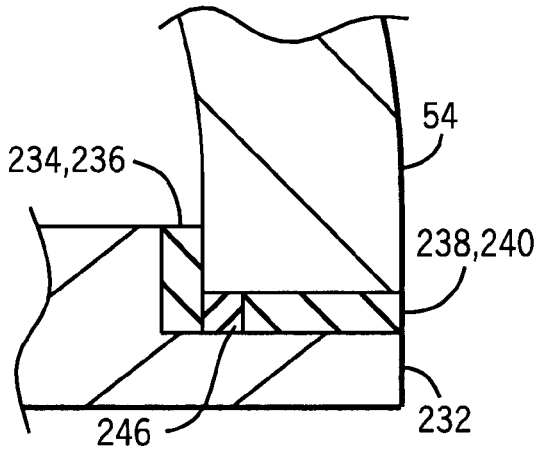
FIGS. 17-19 are close-up cross-sectional views illustrating alternative configurations of the seal illustrated in FIG. 16.
Figure 18:
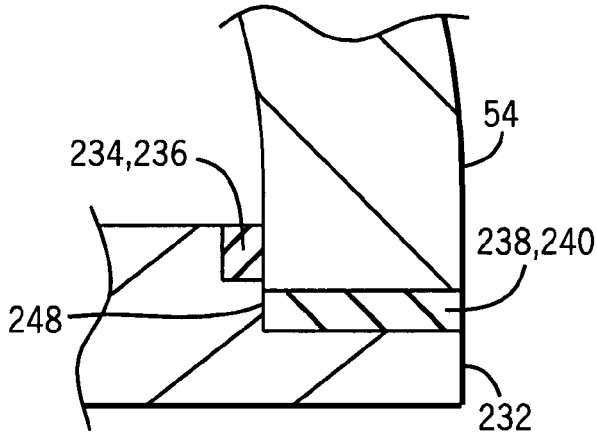
Figure 19:
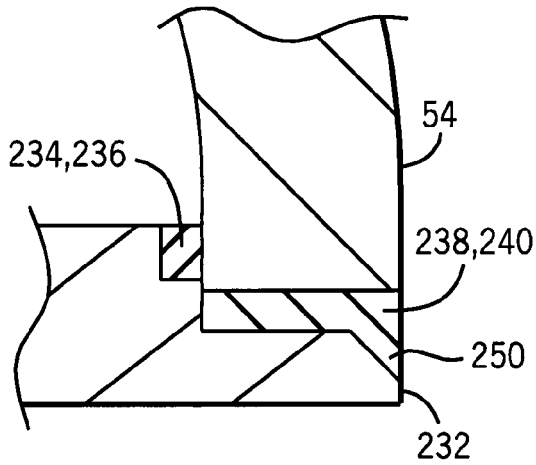

Turning now to FIGS. 17-19, various other embodiments of the multi-seal-material joint 230 are illustrated in close-up cross-sectional views. In FIG. 17, a barrier material 246 is disposed between the seal materials 234 and 238 to isolate the two seals as discussed above. FIG. 18 illustrates an alternative embodiment of the multi-seal-material joint 230, wherein the stepped-endcap 232 has an additional step or flange portion 248 extending between the two seal materials 234 and 238. Additionally, one or more of the seal interfaces 236 and 240 may have an angled geometry to facilitate the sealing process between the arc envelope 54 and the endcap 232. In FIG. 19, the stepped endcap 232 is provided with an angled section 250 along the end interface 240.

Figure 20:
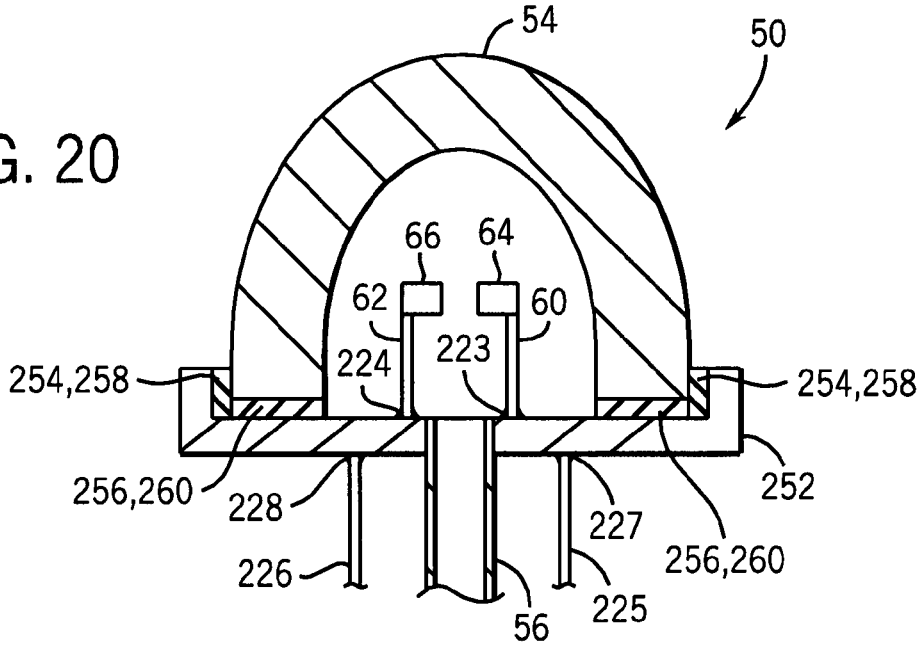
FIGS. 20-21 are cross-sectional side views of further embodiments of the lamp illustrated in FIG. 3 illustrating alternative endcaps and seal configurations.

Further alternative embodiments of the lamp 50 are illustrated with reference to FIGS. 20 and 21. In the embodiment of FIG. 20, an enclosing endcap 252 is disposed about an outer-end region of the arc envelope 54. As discussed in detail above, a variety of sealing techniques may be used to couple the endcap 252 to the arc envelope 54. However, in the illustrated embodiment, seal materials 254 and 256 are disposed between the endcap 252 and the arc envelope 54 at an outer circular interface 258 and an end interface 260 of the arc envelope 54. Again, these seal materials 254 and 256 may comprise identical or different sealing substances, which can be separated by a barrier material or flange to facilitate the sealing process. Moreover, localized heating can be applied in a multi-step curing process to provide different properties in the two seal materials 254 and 256.

Figure 21:
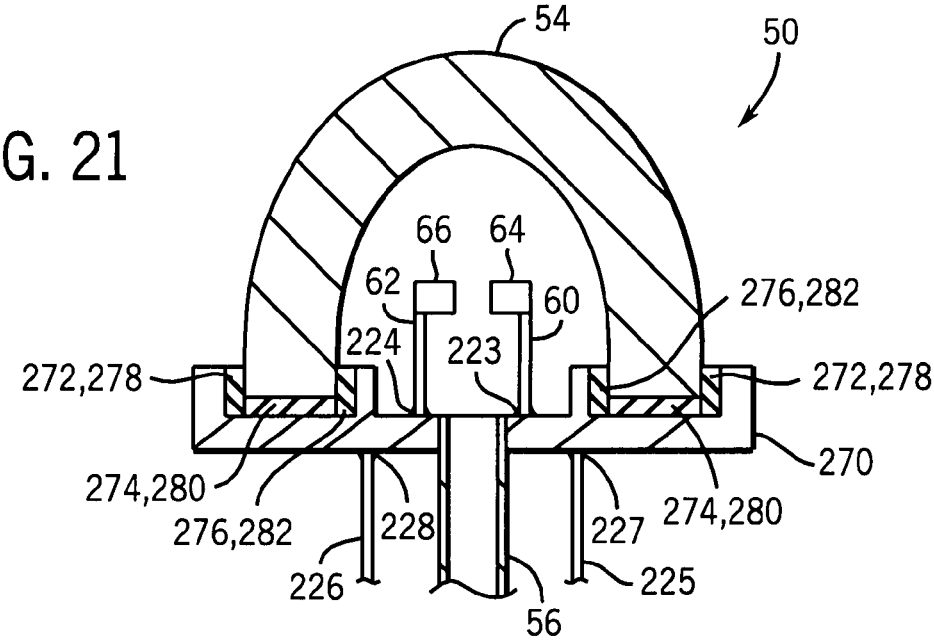

As illustrated in FIG. 21, a slot-type endcap 270 is coupled to the arc envelope 54 of the lamp 50. In this exemplary embodiment, the lamp 50 has three different sealing interfaces between the arc envelope 54 and the endcap 270. These different sealing interfaces may be bonded or seal together via material diffusion or cosintering, one or more seal materials, localized heating, and so forth. In the illustrated embodiment, seal materials 272, 274, and 276 are disposed between the endcap 270 and the arc envelope 54 at an outer circular interface 278, an end interface 280, and an inner circular interface 282, respectively. One or more of these seal materials 272, 274, and 276 may comprise identical or different sealing substances. Also, one or more of these seal materials may be substituted with a material diffusion process or no bonding mechanism. Localized heating also may be used to cure the various seal materials and/or to provide different properties in the three seal materials 272, 274, and 276.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method of making a lamp, comprising:

providing a ceramic arc envelope and a ductile dosing tube;

dosing the ceramic arc envelope with a desired dosing material through the ductile dosing tube;

mechanically compressing the ductile dosing tube to close a portion of the dosing tube; and focusing heat on the portion to hermetically seal the portion of the dosing tube via material diffusion without a seal material.

2. The method of claim 1, wherein focusing heat comprises laser welding the portion of the dosing tube.

3. The method of claim 1, wherein the ductile dosing tube is made of a molybdenum-rhenium material.

4. The method of claim 1, wherein the ductile dosing tube comprises a molybdenum-rhenium alloy having 35 to 55 percent weight of rhenium.

5. The method of claim 1, wherein the ductile dosing tube comprises a molybdenum-rhenium alloy having 44 to 48 percent weight of rhenium.

6. The method of claim 1, comprising inserting an electrode lead through the ductile dosing tube to support an arc tip inside the ceramic arc envelope, wherein compressing the ductile dosing tube comprises compressively securing the electrode lead.

7. The method of claim 1, wherein dosing comprises evacuating the ceramic arc envelope and subsequently injecting the desired dosing material through the ductile dosing tube.

8. The method of claim 1, comprising thermally bonding the ceramic arc envelope to the ductile dosing tube via material diffusion without an intermediate seal material.

9. The method of claim 1, comprising thermally bonding an end structure to the ceramic arc envelope via material diffusion without any intermediate seal material.

10. The method of claim 9, comprising thermally bonding the ductile dosing tube to the end structure via material diffusion without any intermediate seal material.

11. The method of claim 1, comprising butt-joining an endcap to the ceramic arc envelope without extending the endcap into the ceramic arc envelope.

12. The method of claim 1, comprising coupling an end structure to the ceramic arc envelope, wherein the end structure is made of a molybdenum-zirconia cermet.

13. The method of claim 12, wherein the molybdenum-zirconia cermet comprises 35 to 70 percent by volume of zirconia.

14. The method of claim 12, wherein the molybdenum-zirconia cermet comprises 55 to 65 percent by volume of zirconia.

* * * * *